United States Patent [19]

Burzlaff et al.

[11] 4,004,673

[45] Jan. 25, 1977

[54] WIRE MATRIX PRINTHEAD HAVING FACILITY FOR ENABLING WIREWEAR CORRECTION

[75] Inventors: Karl H. Burzlaff, Danville; Carmelo Sanchez, Castro Valley, both of Calif.

[73] Assignee: The Singer Company, New York, N.Y.

[22] Filed: Aug. 15, 1975

[21] Appl. No.: 604,964

Related U.S. Application Data

[63] Continuation of Ser. No. 482,917, June 25, 1974, abandoned.

[52] U.S. Cl. ..... 197/1 R; 101/93.05

[51] Int. Cl.[2] ..... B41J 3/04

[58] Field of Search ..... 197/1 R; 101/93.04, 101/93.05; 308/1 R, 3 R, 3.9, 17, 63

[56] References Cited

UNITED STATES PATENTS

| | | | |
|---|---|---|---|
| 2,785,627 | 3/1957 | Johnson | 197/1 R X |
| 3,698,528 | 10/1972 | De Graff | 197/1 R |
| 3,842,955 | 10/1974 | Iwasaki | 197/1 R |

FOREIGN PATENTS OR APPLICATIONS

| | | | |
|---|---|---|---|
| 1,577,409 | 8/1969 | France | 197/1 R |

*Primary Examiner*—Ralph T. Rader
*Attorney, Agent, or Firm*—Edward L. Bell; Robert E. Smith; Charles R. Lewis

[57] ABSTRACT

A wire matrix printhead having a plurality of wire styli wherein each stylus is capable of being actuated by an electromagnetically actuated hammer. Each of the wire styli has an input end which is impacted by the armature of an electromagnet and has an output end which is used to impact a recording medium for printout purposes. The impact or input ends of each of the wire styli are arranged or configured along the periphery of an ellipse while the output or printout ends of the wire styli are arranged in a straight line configuration. Each of the wire styli are of equal length to the others and they all reside in a straight line longitudinal elongation. The output or printing ends of each of the wire styli are held in a jeweled bearing which is capable of being retracted to expose the printing ends of the wire styli for grinding and polishing and other corrective actions. This permits the wire matrix printhead to have its life extended three to four times its normal usage period.

4 Claims, 5 Drawing Figures

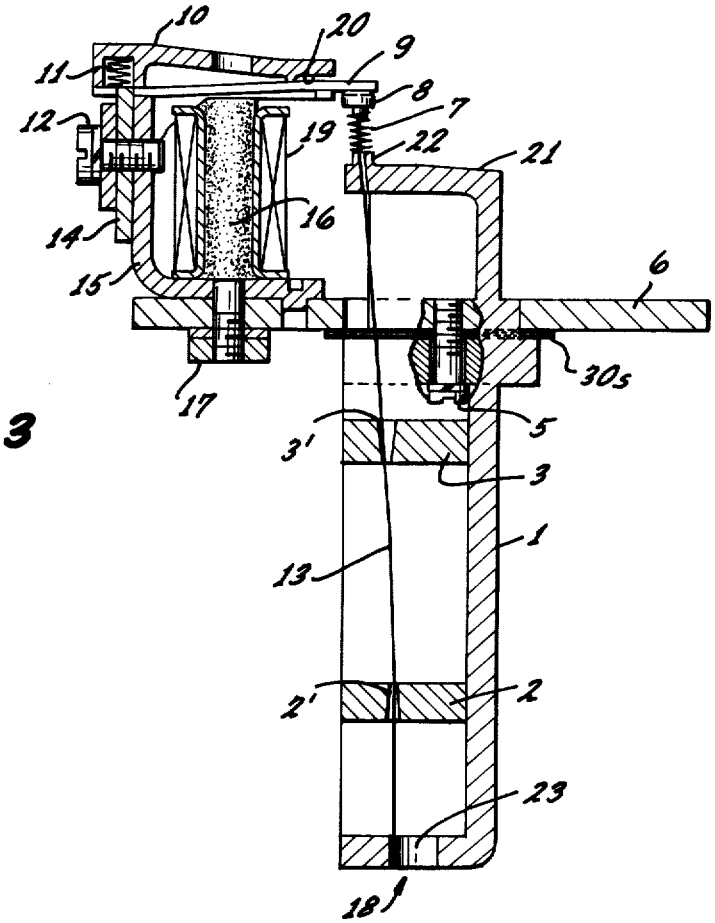
FIG. 3
FIG. 4A
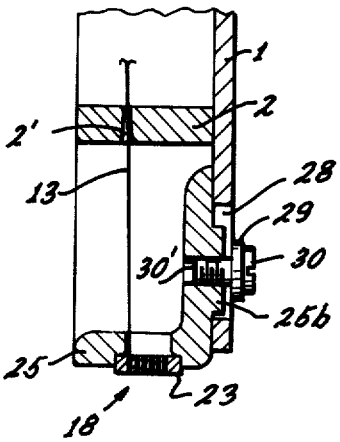
FIG. 4B
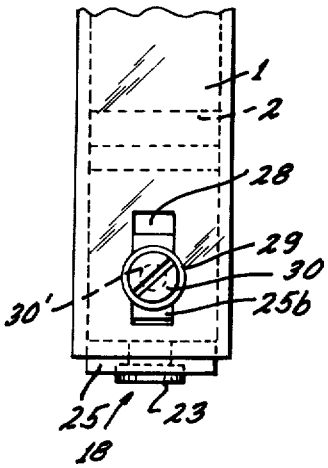

WIRE MATRIX PRINTHEAD HAVING FACILITY FOR ENABLING WIREWEAR CORRECTION

This is a continuation, of application Ser. No. 482,917, filed June 25, 1974, now abandoned.

CROSS REFERENCES TO RELATED APPLICATIONS

This invention is related to and involves an improvement on U.S. Ser. No. 354,574, entitled: "WIRE MATRIX PRINTHEAD," filed Apr. 26, 1973 now abandoned, in the name of Donald G. Herbert and assigned to the same Assignee as the Assignee of the instant application.

BACKGROUND OF THE INVENTION

1. Field of the Invention

This invention relates to a high-speed wire matrix printhead where a plurality of thin wire styli are selectively impacted in order to deliver an impact to a record medium.

An earlier application, Ser. No. 354,574, and assigned to same Assignee as the instant invention, described a wire matrix printhead which is moved across a printing medium wherein selective actuation of a number of wire styli is used to imprint character indicia on the record medium as the printhead moves across it. In this earlier described embodiment, a number of efficacious features were described which provided a high-speed capability together with a minimal amount of activation and adjustment means. These features included the positioning of the wire styli in a substantially straight line yet so configured that the impact receiving ends of the wire styli were arranged along the periphery of an ellipse and the printing ends of the wire styli (impact causing ends) were aligned in a straight line. Further, the features included styli of equal length and the ability to adjust the stroke length of each individual hammer of each activated electromagnet for each stylus.

The present invention adds to this combination a unique adjustment means whereby the printout or output ends of the wire styli may be temporarily exposed for corrective grinding purposes in order to renew the working life of the wire styli.

Generally, print wires of matrix printheads are susceptible to wire wear after long periods of printing. The wire tips (output ends) shorten and begin to recess into the wire guide causing improper print impression. The wear on various styli tips is uneven since certain styli are used much more than others during the course of printing 40–50 million characters. The result is that certain tips are shorter due to wear while others are longer. It is important to restore the original wire stroke length measured from the output side of the wire guide toward the recording medium, so that character printout will be uniform and of proper print density.

Customarily, in order to accomplish the readjustment for wire tip wear, the prior art often used a method of taking the electromagnetic structures (at the input or impact receiving end of the wire styli) and readjusting them downward, in order to bring the tips or output ends of the wire styli flush with the output side of the wire guide which held the styli. This was to insure that when one individual wire stylus was activated, it would elongate itself from the wire guide face to the proper extension length designed for impact on a record medium.

Other prior art methods, when faced with a problem of the wearing and shortening of the tips of the wire styli at the output or printout end used a system of moving back the wire guide housing by such methods as removing shims or spacers which determined the position of the printing end of the wire guide housing.

In the prior art situation where each individual magnet and wire was readjusted downwardly and individually to assure "flushness" of all the print wires at the edge of the wire guide, it was a painstaking and delicate task to try to readjust each of the electromagnet actuating devices to assure flushness of each of the various print wires at the output or printout tips. In so doing, this readjustment operation, involving the lowering of the magnetic or electromagnetic actuators, would alter the design characteristic of the print wire stylus return spring which would alter the spring rate applied to the wire stylus and thus effect the time and the force with which the print wire stylus would arrive at the paper recording medium.

Since, during the life of the product, there are several readjustment periods required, then the total value of the change of the spring rate could become deleteriously significant when using the old prior art methods of readjustment.

SUMMARY OF THE INVENTION

The present invention provides for an adjustable portion of the guide housing so as to make movable the jeweled bearing at the output end of the wire styli. Initially the output ends of the wire styli rest in a jeweled bearing which aligns them in a straight line wherein the tips of each stylus are made flush with the outer end of the jeweled bearing. After a long period of use the tips of the wire styli will be worn to various degrees and thus no longer be flush with the outer edge of the jeweled bearing; and some tips will recede slightly inward within the jeweled bearing due to the wearing down of the tips as a result of multitudinous operations. It is at this time that a regrinding and alignment operation is needed in order to insure that each of the wire styli will elongate a proper distance outside of the end of the wire guide when the styli are activated.

In the present invention the adjustably supported outer end guide housing which holds the jeweled bearing may be temporarily moved back to expose the tips of the wire styli so that all tips may be ground flush and be in perfect alignment at the output end by this corrective grinding adjustment. By use of the movable guide housing flange, the tips of the wire styli may be perfectly aligned with the outer edge of the jeweled bearings so that the elongation or extension stroke of each of the wire styli from the edge of the jeweled bearing will be the correct length of the desired stroke.

Since this adjustment can be made several times, the useful life of the wire matrix printhead can be extended three to four times resulting in eliminating the need for buying a new printhead or contracting for expensive repair and adjustment services.

BRIEF DESCRIPTION OF THE DRAWINGS

FIG. 3 shows a side view of a cutout (3—3 of FIG. 2) of a wire matrix printhead illustrating the outer wire guide housing and a prior art adjustment means for moving the jeweled bearing to expose the wire styli tips.

FIG. 4A is a side view, similar to FIG. 3, showing the improved wire guide housing.

FIG. 4B is a side view of a portion of the lower wire guide housing showing the slot provided for adjusting the lower wire housing jewel supports.

DESCRIPTION OF THE PREFERRED EMBODIMENT

Figure 1:
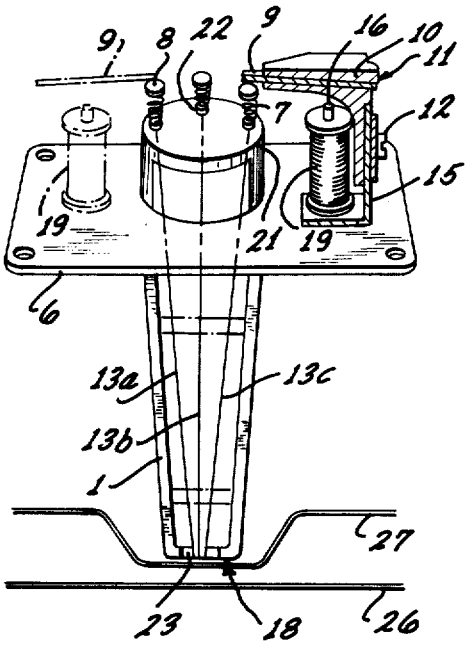
FIG. 1 is an isometric and schematic representation of a wire matrix printhead showing the major components in cooperative relationship.

In FIG. 1 there is seen a side or elevation view of a simplified schematic drawing of the wire matrix printhead. Only the essential elements are shown for clarity while the other elements are shown in other drawings.

A metal mounting plate 6 is shown supporting a stylus wire guide assembly 1 and also a series of electromagnetic armatures 9 in a general configuration which surround the central portion of the wire guide assembly 1, especially the area designated 21 which is the upper portion of the wire guide assembly and which may be designated as a cylindrical block through which the stylus wires (such as 13*a*, 13*b*, 13*c*, etc.) pass and which terminate in a head or impact button 8 located proximately to an armature 9.

It will be seen that relative downward motion of the magnetic armature 9 will operate so as to strike the impact head or button 8 in order to drive into motion a wire stylus such as 13, which at the "output end" 18, will extend beyond the base of the wire guide assembly in order to press against a ribbon 27 and paper recording medium 26 in order to imprint a dot marking. After the finish of the hammer impact of armature 9 against the impact button 8, then the compression or return spring 7 will cause the stylus to return upward into its normal or home position.

Referring to FIG. 1 and FIG. 3, the armature 9 is held in an electromagnet assembly in which a magnetic core 16 is surrounded by a coil 19 in a general configuration about the cylindrical block extension 21. A nut 17 holds the magnetic core 16 to the mounting plate 6 in addition to securing the magnetic yoke 15 which bends from the base up around the side of the magnetic core 16.

Adjustably attached to the magnetic yoke 15 is an armature retainer 10 which holds or retains the magnetic armature 9 in close proximity to the top of the magnetic core 16.

A loading spring 11 ensures that the outer end of the armature 9 will be maintained in close proximity to the top of yoke 15 in order to maintain a continuous circuit for magnetic flux. At the inside or hammer end of the armature retainer 10, there is provided a backstop or bumper cushion 20 which cushions the return shock of the armature back against the retainer 10.

The actual stroke or motion distance accomplished by the armature 9 in its hammer-like action against the stylus impact button head 8 is determined by adjusting the height of the armature retainer 10 by means of screw 12 and a mounting clamp 14.

Seen in FIG. 3 between the guide housing 1 and metal support plate 6, is a shim or group of shims $30_s$. There are flat metal pieces having a U-shape and having a thickness on the order of 0.005 inch. In the prior art, a group of such shims were used so that if it were desired to expose the styli tips, then screw 5 could be loosened so as to pull out one of the shims, after which screw 5 would be tightened again, thus exposing the styli tips for corrective grinding.

Figure 2:
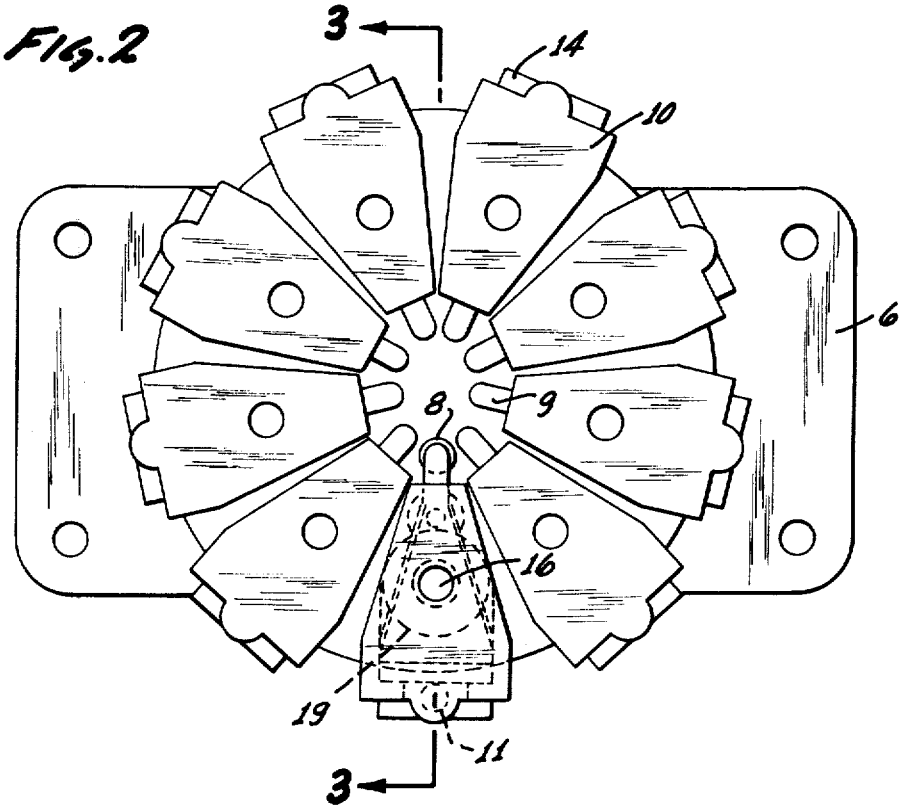
FIG. 2 is a plan view of the wire matrix printhead showing an arrangement of 9 electromagnetic armatures which are used as hammers to guide the wire styli.

In FIG. 2, there is shown a plan or top view of a wire matrix printhead showing a series of 9 magnetic armatures (hammers) places in a configuration about the circular cylindrical block 21. Each armature 9 covers the impact button head 8 of the individual wire styli which may be actuated into motion underneath the armature tip 9.

The entire assembly of the 9 electromagnets and armatures is supported on the mounting plate 6 and one particular electromagnet is shown in greater detail in order to illustrate what lies underneath. As will be seen by the broken lines, there rests a core 16 underneath each of the armature retainers 10. At the extreme end of each armature retainer, there is found a small housing which carries the armature loading spring 11 (as shown by the dotted line) and a coil 19 is placed around the core 16.

Referring to FIG. 3, a side cutout view of the matrix printhead is shown (along cutout 3—3 of FIG. 2). The wire guide assembly 1 is shown having an input end 21 (which consitutes the cylindrical circular block at the input end) and a planar output end 18 having a scalloped rudy bearing 23 through which pass the stylus wires 13.

The stylus wires 13 are flexibly supported by a cross brace with an aperture and designated as the lower wire support 2. Likewise, an upper wire support 3 is also provided.

At the extreme top end of the wire guide assembly 1, there will be found a series of apertured extensions, designated as 22, which receive the stylus wire, such as 13, and act as a guide and support factor.

The stylus wire 13 has at its extreme top a plastic impact button which receives the impact from armature 9 and which is rigidly and fixably attached to the stylus to carry the motion of the armature to the wire stylus. Between the impact button 8 and the apertured extension 22, there resides a wire return spring 7. This is a compression spring which acts to cause the wire stylus 13 to return to its normal home or rest position after activation by the hammering impact of the armature 9.

Also seen in FIG. 3 is the mounting means by which the wire guide assembly 1 is mounted to the mounting plate 6. This is accomplished by mounting screw 5 which connects the wire guide assembly to the mounting plate.

In FIG. 3, on the left side of the mounting plate 6, there is seen the electromagnet assembly consisting of magnetic core 16, a magnetic yoke 15, a mounting nut 17 for holding the core to the mounting plate 6, an electric coil 19 placed around the core 16, and an armature 9 which is held in place and retained by armature retainer 10. The armature retainer 10 is adjustably attached to the yoke 15 by means of screw 12 and mounting clamp 14. At the outward portion of the armature retainer 10, there is seen a loading spring 11 which serves as an armature loading spring to maintain the armature in a set position when the magnetic coil is de-energized.

The apparatus of the instant invention is constructed so as to be of rugged, durable, long-wearing construction while, at the same time, being of minimal size and mass in order to facilitate the movement not only of the wire styli and the armature hammers, but also the entire assembly into an easily accelerated condition from any static condition.

Thus, typically illustrative of an embodiment of the present invention is the feature where the wire styli such as $13_a$, $13_b$, $13_c$, etc. are composed of wire having a circular diameter of 0.014 of an inch and having an elongated length of 2.52 inches from the output end tip to the input end tip.

The armature 9 is preferably made of magnetic material such as 2.5% silicon-iron, for example, having a thickness of 0.035 to 0.036 of an inch, said armature being held in place or mounted within a plastic armature retainer 10. The magnet core 16 is typically only approximately 3/16 of an inch in diameter and made of 2½% silicon-iron. The major usable length of the magnetic core is approximately 0.65 inches.

The wire guide and holder assembly 1 is made of strong but light plastic material, such as fortified plastic. In addition to the apertured extension 22 which positions the wire stylus at the impact receiving end, there are also two wire guide supports, an upper wire guide support 3, and a lower wire guide support 2. A tapered hole 3' and a tapered hole 2' are respectively placed in the upper and lower wire guide supports for maintaining the stylus in practically a straight line contact from the impact button 8 to the end or tip of the stylus at the output end 18.

The same features are true for each of the other eight styli, that is to say, that the upper wire guide support 3 and the lower wire guide support 2 are provided with suitable tapered apertures or openings which guide each individual wire stylus in a straight line contact to the termination point at the output end 18.

At the output end 18, there is inserted a bearing 23 which receives and aligns the plurality of wire styli into a straight line such that the tip of the wire styli will lie in a flat plane. This is of course only true when the styli are in their rest position, as they will extend upon activation according to the stroke adjustment of the armature hammer which may drive them.

The yoke 15 of the electromagnet may be made of 1% silicon-iron and may have a thickness of 0.075 of an inch or approximately 14 gauge. The mounting plate 6 for the print head may be made of aluminum material approximately 1/10th of an inch thick.

The coil 19 which is placed around the core 16, after having been mounted on a nylon bobbin, may be composed of 200 turns of No. 30 wire and having a resistance of 2.0 ohms at room temperature.

Because of the simplicity of parts and assemblies of the subject mechanism, it is an easy task to replace the armature 9 which is normally of 20 gauge silicon-iron and increase its mass by, for example, making it of 15 gauge silicon-iron.

In FIG. 4A, there is seen the lower housing portion of the printhead with the improved means for facilitating correction for wire-tip wear.

The lower portion of the wire guide assembly 1 will be seen to have a jeweled bearing 23 supported by a fixed, yet adjustable, flange support 25 which is held to the main housing by means of a washer 29 and screw 30. The screw extends through a slot 28 cut in the top of the housing 1 (as best shown in FIG. 4B) and the flange support 25 has a hole 25' through which the screw 27 may be inserted.

The slot 28 in the housing 1 and a matching boss $25_b$ of flange support 25 assure longitudinal guiding of the jeweled bearing 23.

In FIG. 4B, there is seen a view of the lower wire guide housing taken along the line CC of FIG. 4A. The guide housing 1 is seen with a slot 28 in which there fits the boss $25_b$ which is movable to-and-fro in the slot 28. A screw 30 and washer 29 may be used with hole 30' to hold the boss and the entire flange support 25 in a fixed locked position.

OPERATION

The operation of wire matrix printheads using wire styli and actuated by selected electromagnets is well-known in the art of wire matrix printing, and is also described in the copending application Ser. No. 354,574.

In the instant embodiment, an unusual feature is provided in that the flange support 25 which holds the jeweled bearing 23 is provided with a structure making the flange support and the jewel movable in the upward direction.

As seen in FIGS. 4A and 4B, a slot 28 is provided by which the flange support 25 may be moved by means of the loosening of screw 30.

The movement of the flange support 25, after the loosening of the screw 30, is done in order to pull the flange support 25 and the jeweled bearing 23 upwardly in order to expose the tips of the wire styli 13 at the output end 18.

This exposure is done very slightly on the order of possibly a few thousandths of an inch, in order that a grinding or polishing tool may be run over the tips of the wire styli 13 in order to make them flush one with the other and to eliminate any uneven areas of wear, thus rehabilitating the printhead for many millions of operations of furture usage.

Thus, the sequence would be, say possibly after 40 million character-printing operations: loosening the screw 30 and very slightly retracting the flange support 25 a few thousandths of an inch. At this time a grinding tool would be used to grind the styli tips into a flat and flushed position with the jeweled bearing 23 after the flange support 25 has been tightened into position. This would then insure that all of the tips of the wire styli had been flatted and polished to a flat even line and also that the length of each of the styli wires 13 would not also be of the same overall length so that during a period of activation, the elongation or stroke outthrust would be the same for one wire stylus as for all of the rest.

If one or more of the wire styli were not of equal length to the other, then the outthrust or elongation, beyond the jeweled bearing of certain of the wire styli would be greater than others, leading to the poor output printout when the wire styli are impressed against the ribbon.

The improved printhead of the instant invention provides the facility for exposure of the unevenly worn tips of the wire styli in a fashion such that the regrinding of all the tips jointly into the same plane assures a perfectly balanced wire mass after the reworking. This is of extreme importance for obtaining uniform dot printing density on the recording media.

In the older methods of reworking when, after 30 to 40 million character printings, it was observed that the printout characters were weak, illegible and of varying print densities, an inspection would show that certain of the tips of the styli were worn more than others. Thus, the printout end of the wire styli would be of different lengths. These older methods of reworking would generally attempt to find the longer of the wire styli and individually try to grind the longer tips down to the size of the shortest tip in order to get an evenly balanced plane of tips. However, this rough method would often leave the tips different in length by as much as one wire diameter or more, with the resultant uneven quality of character printout.

The present invention permits the tips to be ground so flush and so finely that each dot of the printed character will be uniformly impacted and printed.

Thus, the printhead may be made as good as new, and again be suitable for many millions of character printouts with uniformly proper density of printout.

What is claimed is:

1. In a wire matrix printing head comprising a guide assembly for retaining a plurality of wire styli each of which styli has an input end for receiving an impact and an output end for delivery of an impact to a recording medium, said assembly having guide means adjacent one end thereof for holding and aligning the input ends of said wire styli and with electromagnetic activation means for delivering motion and velocity to selected ones of said plurality of styli, and output bearing means located adjacent the other end of said assembly to hold the output ends of said wire styli, the combination wherein:

said output bearing means includes a plurality of apertures with each aperture having its axis in alignment with an axis of one of said wire styli, said output bearing means providing a planar face on one side thereof with the tips of the wire styli flush with said planar face, and means movably mounting said bearing means to said guide assembly to enable altering of the position of said output bearing means and said planar face along the longitudinal length of said styli and in relationship to the output end tips of said wire styli, said movable mounting means including means for releasing said bearing means from said guide assembly and for securing said bearing means in a desired position on said assembly.

2. The wire printhead of claim 1 wherein said movable mounting means for altering said output bearing means includes a boss, and wherein said guide assembly includes a section having a slot, and said boss of said movable mounting means is precisely positionable longitudinally within said slot.

3. The wire printhead of claim 1 wherein said movable mounting means includes;

a member supporting said bearing means, said member slidably attached to said guide assembly.

4. The wire printhead of claim 3 wherein said support member is flanged.

* * * * *

UNITED STATES PATENT OFFICE

CERTIFICATE OF CORRECTION

PATENT NO. : 4,004,673

DATED : January 25, 1977

INVENTOR(S) : Karl H. Burzlaff and Carmelo Sanchez

It is certified that error appears in the above-identified patent and that said Letters Patent are hereby corrected as shown below:

Column 4, line 8 "places" should read -- placed --

Column 6, line 48 "not" should read -- now --

Signed and Sealed this

Twelfth Day of April 1977

[SEAL]

*Attest:*

RUTH C. MASON
*Attesting Officer*

C. MARSHALL DANN
*Commissioner of Patents and Trademarks*